US008378774B2

(12) United States Patent
Okada et al.

(10) Patent No.: US 8,378,774 B2
(45) Date of Patent: Feb. 19, 2013

(54) COIL UNIT AND ELECTRONIC APPARATUS USING THE SAME

(75) Inventors: Hirofumi Okada, Suwa (JP); Yoichiro Kondo, Chino (JP)

(73) Assignee: Seiko Epson Corporation, Tokyo (JP)

( * ) Notice: Subject to any disclaimer, the term of this patent is extended or adjusted under 35 U.S.C. 154(b) by 377 days.

(21) Appl. No.: 12/434,258

(22) Filed: May 1, 2009

(65) Prior Publication Data

US 2009/0278651 A1 Nov. 12, 2009

(30) Foreign Application Priority Data

May 12, 2008 (JP) ..... 2008-124665

(51) Int. Cl.
*H01F 5/00* (2006.01)
*H01F 27/28* (2006.01)
*H01F 27/08* (2006.01)

(52) U.S. Cl. ..... 336/200; 336/55; 336/179; 336/232

(58) Field of Classification Search ..... 336/55, 336/179, 200

See application file for complete search history.

(56) References Cited

U.S. PATENT DOCUMENTS

| | | | | |
|---|---|---|---|---|
| 4,777,436 | A * | 10/1988 | Fiori, Jr. | 324/207.17 |
| 5,103,335 | A * | 4/1992 | Sugiura | 359/212.1 |
| 6,906,495 | B2 * | 6/2005 | Cheng et al. | 320/108 |
| 2003/0020583 | A1 * | 1/2003 | Hui et al. | 336/200 |
| 2004/0032313 | A1 * | 2/2004 | Ferencz et al. | 336/200 |
| 2005/0141591 | A1 * | 6/2005 | Sakano | 374/163 |
| 2006/0028384 | A1 * | 2/2006 | Akiho et al. | 343/742 |
| 2007/0133967 | A1 * | 6/2007 | Takahashi et al. | 396/55 |
| 2008/0164840 | A1 * | 7/2008 | Kato et al. | 320/108 |

FOREIGN PATENT DOCUMENTS

| | | | |
|---|---|---|---|
| JP | U-1-156073 | | 10/1989 |
| JP | 08175085 | A * | 7/1996 |
| JP | A-11-164498 | | 6/1999 |
| JP | A-2000-269059 | | 9/2000 |
| JP | 2001258182 | A * | 9/2001 |
| JP | A-2001-258182 | | 9/2001 |
| JP | A-2005-525705 | | 8/2005 |
| JP | A-2006-60909 | | 3/2006 |
| JP | A-2008-235860 | | 10/2008 |
| JP | A-2008-235862 | | 10/2008 |
| WO | WO 03/096361 | A1 | 11/2003 |
| WO | WO 03/096512 | A2 | 11/2003 |

* cited by examiner

*Primary Examiner* — Mohamad Musleh
*Assistant Examiner* — Tsz Chan
(74) *Attorney, Agent, or Firm* — Oliff & Berridge, PLC

(57) ABSTRACT

A coil unit includes a coil including a coil wire, a magnetic substance for receiving magnetic force lines generated by the coil, a first substrate, and a temperature detection element disposed on the first substrate.

11 Claims, 6 Drawing Sheets

COIL UNIT AND ELECTRONIC APPARATUS USING THE SAME

Japanese Patent Application No. 2008-124665 filed on May 12, 2008, is hereby incorporated by reference in its entirety.

BACKGROUND

1. Technical Field

The present invention relates to a coil unit suitable for contactless power transmission and an electronic apparatus or the like using the coil unit.

2. Related Art

There is known contactless power transmission that uses electromagnetic induction to transmit power without using a metal contact. As applications of contactless power transmission, charging of a cell phone, charging of a home appliance (e.g., a handset), and the like have been proposed.

A related-art examples of contactless power transmission is JP-A-2006-60909. In JP-A-2006-60909, a resonant capacitor connected to the output of a power transmission driver and a primary coil constitute a series resonant circuit and a power transmission unit (primary) provides power to a power reception unit (secondary).

In recent years, cell phones are required to be downsized further. For this reason, a coil unit for transmitting power must also be further downsized, particularly, in the thickness dimension.

For example, if a foreign object such as a metal piece intrudes into the gap between the primary coil and secondary coil during contactless power transmission, the foreign object generates an eddy current thereby causing heating.

SUMMARY

An advantage of the invention is to provide a coil unit having a structure that is allowed to reliably detect an abnormality such as the intrusion of a foreign object, and an electronic apparatus using the coil unit.

A coil unit according to an aspect of the invention includes a flat coil formed by winding a coil wire, a magnetic substance for forming a magnetic path for the flat coil, a flexible substrate disposed in parallel with the flat coil, and a temperature detection element mounted on the first substrate.

In the aspect of the invention, the temperature detection element is mounted on the first substrate disposed in parallel with the flat coil. For this reason, when a foreign object intrudes the gap between the primary and secondary coils each including such a flat coil, heating caused by an eddy current generated by the foreign object can be detected. Also, since the flexible substrate is thin unlike a substrate made of a rigid material, the slimness of the coil unit is maintained. Also, by disposing the flexible substrate in parallel with the flat coil, the temperature detection element is disposed in a desired position close to the flat coil.

In the aspect of the invention, the flexible substance may be disposed between the coil wire and the magnetic substance.

This means that the flexible substrate does not exist on the transmission surface of the flat coil, since the magnetic sheet is disposed on the non-transmission surface of the flat coil. This allows reducing the distance between the transmission surface of the primary coil and that of the secondary coil, thereby improving the transmission efficiency Also, since a wiring pattern of the flexible substrate is disposed on the non-transmission surface, magnetic force lines generated on the transmission surface by the flat coil are not adversely affected by the wiring pattern.

In the aspect of the invention, the flat coil may have an air-core in its center. Also, the flat coil may be an air-core coil formed by winding the coil wire on a plane in a spiral fashion and the temperature detection element may be disposed in the air-core of the flat coil.

In the air-core, magnetic flux has a significantly high density. For this reason, when a foreign object intrudes into the air-core, an eddy current generated by the foreign object abruptly increases the temperature thereby causing intense heating. By adopting the above-mentioned configuration, the temperature detection element more reliably detects that the foreign object has intruded into the air-core.

In the aspect of the invention, if one surface of the flat coil is referred to as a transmission surface and the other surface thereof is referred to as a non-transmission surface, the magnetic sheet may be disposed on the non-transmission surface of the flat coil, and the flexible substrate may be disposed between the non-transmission surface of the flat coil and the magnetic substance.

This means that the flexible substrate does not exist on the transmission surface of the flat coil. Therefore, the distance between the transmission surface of the primary coil and that of the secondary coil is reduced so that the transmission efficiency is improved.

In the aspect of the invention, the coil unit may further include a wiring substrate having a coil housing for housing the flat coil. Also, the flexible substrate may be connected to an electrode pattern formed on the wiring substrate.

The disposition of the wiring substrate improves the shape retention property of the coil unit. Since the flat coil is housed in the coil housing provided on the wiring substrate, a part or all of the thickness of the flat coil is absorbed by the coil housing. This minimizes an increase in thickness of the coil unit.

In the aspect of the invention, the flexible substrate and wiring substrate may each have a positioning hole through which a fixture is passed at the time of assembly so that these substrates are positioned with respect to each other.

Since the flexible substrate is connected to the wiring substrate in a state in which these substrates are positioned with respect to each other using the positioning holes, the position of the temperature detection element mounted on the flexible substrate is reliably set.

In the aspect of the invention, the coil wire may be wound around the magnetic sheet so that the magnetic sheet functions as a magnetic core of the flat coil. If the magnetic sheet is thin, a coil using this magnetic sheet as the core can also be formed as a flat coil. If one surface of the magnetic sheet is referred to as a transmission surface of the coil and the other surface thereof is referred to as a non-transmission surface of the flat coil, the flexible substrate may be disposed on the transmission surface of the magnetic sheet or may be disposed on the non-transmission surface thereof. The disposition of the flexible substrate on the transmission surface of the coil is preferable in that the temperature of a foreign object is detected with the magnetic sheet not interposed between the temperature detection element and the foreign object. However, the temperature may be detected with the magnetic sheet interposed therebetween. This means that the flexible substrate is disposed on the non-transmission surface of the coil and is preferable in that the distance between the transmission surface of the primary coil and that of the secondary coil is reduced and that the wiring pattern on the flexible substrate does not adversely affect magnetic force lines on the transmission surface.

An electronic apparatus according to another aspect of the invention includes a coil unit having the above-mentioned structure.

BRIEF DESCRIPTION OF THE DRAWINGS

The invention will be described with reference to the accompanying drawings, wherein like reference numerals represent like elements.

DESCRIPTION OF EXEMPLARY EMBODIMENT

Now, a preferred embodiment of the invention will be described in detail. The embodiment described below does not unduly limit the invention as set forth in the appended claims. Also, not all the configurations described in the embodiment are essential as means for solving the above-mentioned problems.

1. Charging System

Figure 1:
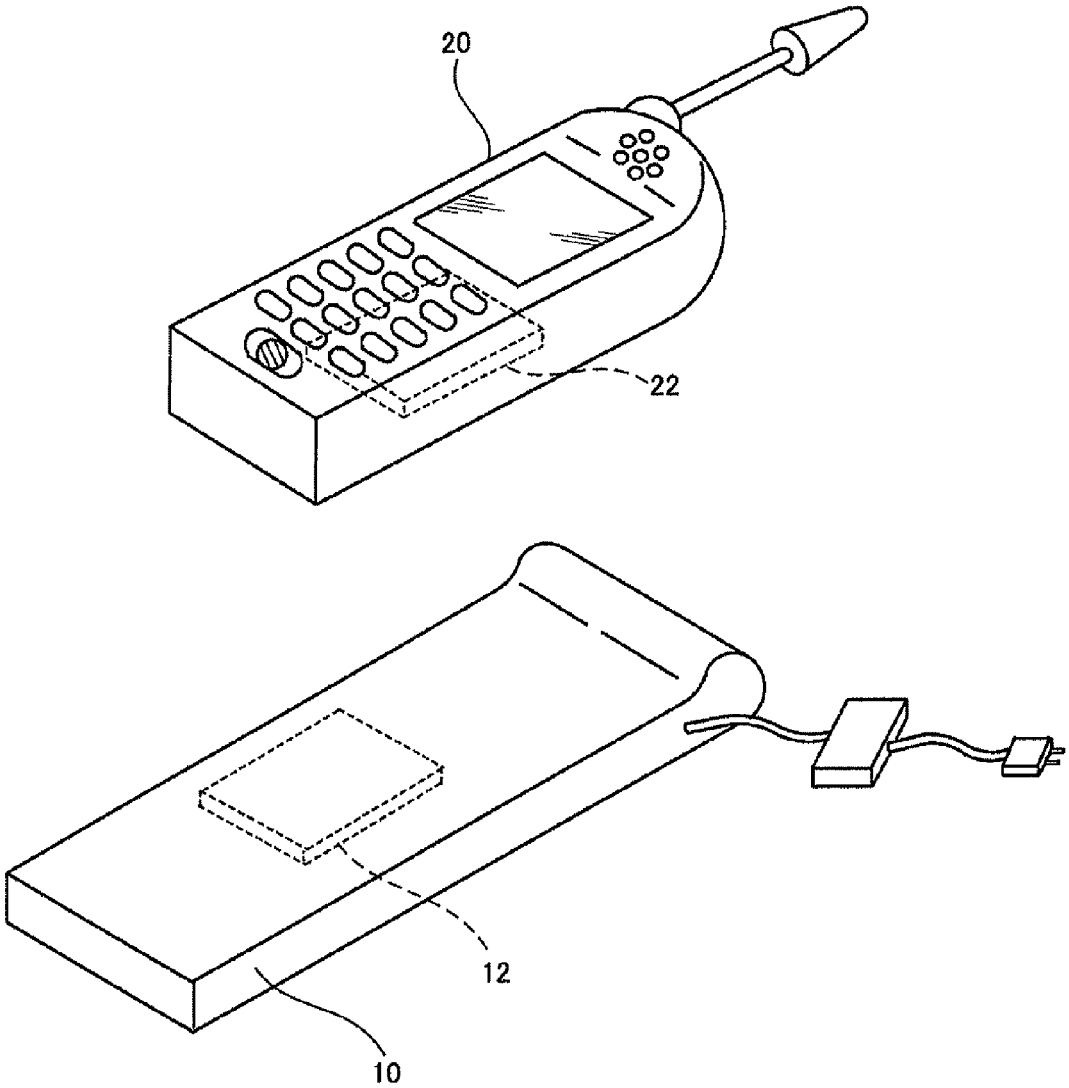
FIG. 1 is a drawing schematically showing a charger and an electronic apparatus charged by the charger, such as a cell phone.

FIG. 1 is a drawing schematically showing a charger 10, which is also an example of an electronic apparatus, and a cell phone 20, which is an example of an electronic apparatus changed by the charger 10. FIG. 1 shows the cell phone 20 to be transversely placed on the charger 10. The cell phone 20 is charged by the charger 10 by means of contactless power transmission using an electromagnetic induction action generated between a coil of a coil unit 12 of the charger 10 and a coil of a coil unit 22 of the cell phone 20.

The charger 10 and cell phone 20 may each have a positioning structure. For example, the charger 10 may have a positioning protrusion protruding out of the outer surface of the case thereof. On the other hand, the cell phone 20 may have a positioning recess on the outer surface of the case thereof. By using such positioning structures, the coil unit 22 of the cell phone 20 is at least disposed in a position opposed to the coil unit 12 of the charger 10.

Figure 2:
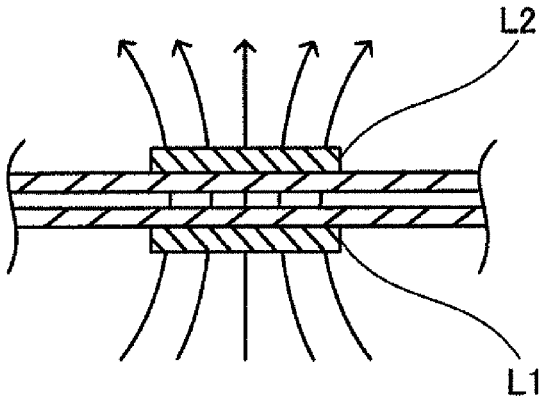
FIG. 2 is a drawing showing an example of a contactless power transmission method.

As schematically shown in FIG. 2, power is transmitted from the charger 10 to the cell phone 20 by electromagnetically coupling a primary coil L1 (power transmission coil) included in the charger 10 and a secondary coil L2 (power reception coil) included in the cell phone 20 and thus forming a power transmission transformer. This realizes contactless power transmission. Note that FIG. 2 shows an example of electromagnetic coupling between the primary coil L1 and secondary coil L2 and that another type of electromagnetic coupling where magnetic force lines are formed in a way different from that in FIG. 2 may be adopted.

2. Coil Unit of Charger (Primary Coil Unit)

Figure 3:
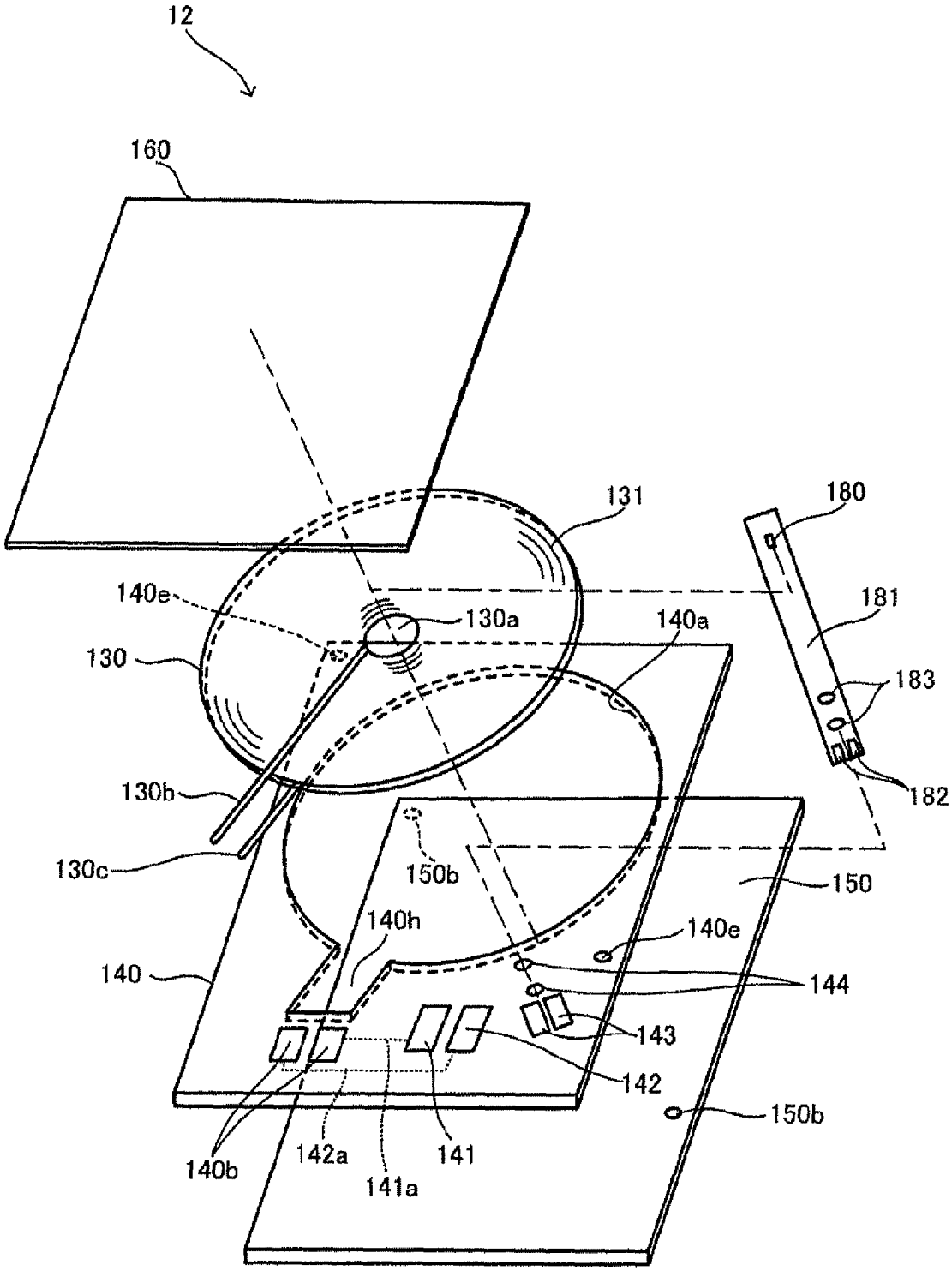
FIG. 3 is an exploded perspective view schematically showing a primary coil unit.

FIG. 3 is an exploded perspective view schematically showing the coil unit 12 of the charger 10. In FIG. 3, the non-transmission surface of the coil unit 12 opposite to the transmission surface thereof opposed to the coil unit 22 of the cell phone 20 in FIG. 1 is seen from above.

The coil unit 12 includes a flat coil 130 formed by winding a coil wire 131 and a magnetic substance 160 for forming a magnetic path for the flat coil 130.

The coil unit 12 also includes a flexible substrate 181 disposed in parallel with the flat coil 130 in a plane in which the flat coil 130 is disposed, and a temperature detection element mounted on the flexible substrate 181, such as a thermistor 180.

Since the coil unit 12 according to this embodiment is a multilayer body where the thin elements, that is, the flat coil 130, magnetic substance 160, and flexible substrate 181 are laminated, the coil unit 12 is thin. Also, the temperature detection element such as the thermistor 180 is disposed in a plane in which the flat coil 130 is disposed; therefore, when a foreign object intrudes into the gap between the primary coil L1 (130) and secondary coil L2 shown in FIG. 2, the thermistor 180 detects an increase in temperature caused by the intrusion.

The flat coil 130 according to this embodiment is an air-core coil that has an air-core 130*a* in its center and is formed by winding the coil wire 131 on a plane in a spiral fashion. In this case, the flexible substrate 181 is disposed in such a manner that the thermistor 180 mounted thereon is positioned in the air-core 130*a* of the flat coil 130. The thermistor 180 and flexible substrate 181 will be described in detail later.

If one surface of the flat coil 130 is referred to as the transmission surface and the other surface thereof is referred to as the non-transmission surface, the magnetic substance 160 according to this embodiment is disposed on the non-transmission surface of the flat coil 130. In this case, the flexible substrate 181 is disposed between the coil wire 131 and magnetic substance 160, that is, between the non-transmission surface of the flat coil 130 and the magnetic substance 160. That is, the flexible substrate 181 does not exist on the transmission surface of the flat coil 130; therefore, the distance between the transmission surface of the primary coil L1 (130) and that of the secondary coil L2 shown in FIG. 2 is reduced. As a result, the transmission efficiency is improved.

The coil unit 12 may also include a wiring substrate 140. The wiring substrate 140 is preferable in that it maintains the shape of the coil unit 12 and in that it electrically relay-connects the flat coil 130 and flexible substrate 181.

The wiring substrate 140 according to this embodiment has a coil housing 140*a*. For example, the coil housing 140*a* is a coil housing hole penetrating the wiring substrate 140 between the front and back surfaces thereof. The flat coil 130 is housed in the coil housing hole 140*a*. Thus, a part or all of the thickness of the spirally-wound, flat coil 130 is absorbed by the coil housing hole 140*a* of the wiring substrate 140 so that the total thickness of the coil unit 12 is reduced. Also, since the transmission surface of the flat coil 130 is exposed via the coil housing hole 140*a* of the wiring substrate 140, the distance between the transmission surface of the primary coil L1 (130) and that of the secondary coil L2 shown in FIG. 2 is reduced. As a result, the transmission efficiency is improved.

A protection sheet 150 for protecting the flat coil 130 and wiring substrate 140 may be provided on the transmission surface of the wiring substrate 140.

Hereafter, the elements will be described more specifically.

The flat coil 130 is not limited to any particular coil if it is a flat coil. For example, an air-core coil formed by winding a single-conductor or multi-conductor coated coil wire on a plane may be used. In this embodiment, a multi-conductor coil wire including dozen or so conductors is used.

As described above, the flat coil 130 is housed in the coil housing 140*a* provided on the wiring substrate 140. This slims down the coil unit 12, as well as makes it easy to make the transmission surface of the flat coil 130 flush with the adjacent surface. Actually, in this embodiment, no recesses or protrusions are formed on the protection sheet 150. Also, the coil housing 140*a* has a shape corresponding to the external shape of the flat coil 130; therefore, if the flat coil 130 is only housed in the coil housing 140*a*, the flat coil 130 is positioned on the wiring substrate 140. This facilitates positioning.

The flat coil 130 has a coil inner end drawing line 130*b* for drawing the inner end of the coil and a coil outer end drawing line 130*c* for drawing the outer end thereof. As shown in FIG. 3, the coil inner end drawing line 130*b* is preferably drawn from the non-transmission surface of the flat coil 130. This prevents the coil inner end drawing line 130*b* from forming protrusions on the transmission surface. This keeps the transmission surface flat, as well as improves the transmission efficiency.

The wiring substrate 140 has a drawing line housing hole 140*h* connecting with the coil housing hole 140*a*. The drawing line housing hole 140*h* is intended to house the coil inner end drawing line 130*b* of the flat coil 130 and coil outer end drawing line 130*c* thereof. By housing the drawing lines 130*b* and 130*c* in the drawing line housing hole 140*h*, that area is slimmed down by the thicknesses of the drawing lines 130*b* and 130*c*. Also, the drawing lines 130*b* and 130*c* are bent relatively gently by the drawing line housing hole 140*h* and then go up onto the wiring substrate 140. This reduces wire breaks.

The coil inner end drawing line 130*b* and coil outer end drawing line 130*c* are drawn to contact electrodes (coil connection terminals) 140*b* and electrically connected to the contact electrodes 140*b* by soldering. The contact electrodes 140*b* are provided on the non-transmission surface (viewer side of FIG. 3) of the wiring substrate 140.

As shown in FIG. 3, the wiring substrate 140 is provided with external connection terminals 141 and 142. The external connection terminal 141 is coupled to one of the contact electrodes 140*b*, for example, via a wiring line 141*a* provided on the back surface (transmission surface) of the wiring substrate 140. The external connection terminal 142 is coupled to the other contact electrode 140*b*, for example, via a wiring line 142*a* provided on the back surface (transmission surface) of the wiring substrate 140. The wiring substrate 140 has multiple (e.g., two) positioning holes 140*e* for positioning the wiring substrate 140 and the protection sheet 150 with respect to each other.

While the protection sheet 150 is a sheet for protecting at least the flat coil 130, it covers both the transmission surface of the wiring substrate 140 and that of the flat coil 130 in this embodiment. The protection sheet 150 is not limited to any particular sheet if it is insulative. As shown in FIG. 3, the protection sheet 150 has positioning holes 150*b* in positions corresponding to the positioning holes 140*e* of the wiring substrate 140. The positioning holes 140*e* and positioning holes 150*b* facilitate positioning between the wiring substrate 140 and protection sheet 150. Also, the protection sheet 150 according to this embodiment has an external shape conforming to that of the wiring substrate 140, but not limited thereto. Also, the protection sheet 150 may be used as a heat dissipation sheet. In this case, the shape (area) of the heat dissipation sheet 150 may be formed so that the area of the transmission surface of the coil unit in contact with the internal shape (area) of an external case is maximized. This further enhances the heat dissipation effect.

Also, since the inner terminal of the flat coil 130 is drawn from the non-transmission surface, the transmission surface is kept flat. This advantageously increases the adhesiveness between the flat coil 130 and protection sheet (heat dissipation sheet) 150 to reduce the thermal contact resistance to facilitate heat dissipation.

The magnetic sheet 160 is bonded to the non-transmission surface of the flat coil 130. The magnetic sheet 160 has basic functions of receiving magnetic flux from the flat coil 130 and increasing the inductance of the flat coil 130. The material of the magnetic sheet may be various magnetic materials such as a soft magnetic material, a ferrite soft magnetic material, and a metal soft magnetic material.

The magnetic sheet 160 of the charger 10 is made of a material having relatively high flexibility. Thus, even if the coil inner terminal drawing line 130*b* of the primary coil 130 and the flexible substrate 181 protrude from the non-transmission surface of the primary coil 130, the magnetic substance 160 deforms itself in accordance with such protrusions. For this reason, there is no need to dispose a spacer for absorbing the thickness of the coil inner terminal drawing line 130*b* or flexible substrate 181 between the primary coil 130 and magnetic sheet 160. Note that since the flexible substrate 181 is extremely thin, the magnetic substance 160 is hardly deformed by the flexible substrate 181.

3. Temperature Detection Element of Primary Coil

If there is a metal foreign object between the coil unit 12 and coil unit 22 in a contactless power transmission system using an electromagnetic induction action as shown in FIG. 1 during power transmission, that foreign object may generate an eddy current to cause heating so that the foreign object and the primary coil 130 overheat. Also, even if there is no such foreign object, the flat coil 130 may overheat for some reason.

Thus, the thermistor 180, which is an example of a temperature detection element (temperature detection sensor) according to this embodiment, is disposed in an area (magnetic force line generation area) where magnetic force lines are generated by the flat coil 130. Particularly, in this embodiment, the thermistor 180 is disposed in the air-core 130*a* of the flat coil 130 so that the temperature of the flat coil 130 and its vicinity is monitored. This is because, in the air-core, magnetic flux has a significantly high density and when a foreign object intrudes into the air-core, an eddy current generated by the foreign object abruptly increases the temperature thereby causing intense heating. By adopting the above-mentioned configuration, the thermistor 180 more reliably detects that the foreign object has intruded into the air-core 130*a*.

When the temperature detected by the thermistor 180 becomes a given temperature or higher, when the ambient temperature and the temperature detected by the thermistor 180 both become a given temperature or higher, or when the speed at which the temperature increases becomes a given value or higher, the driving of the flat coil 130 of the charger 10 may be stopped.

The thermistor 180 is disposed in the air-core 130*a* of the flat coil 130 using the flexible substrate 181. The flexible substrate 181 is provided with the thermistor 180 at one end thereof and an electrode 182 at the other end thereof. The flexible substrate 181 is disposed along a radiation direction (radius direction) from the air-core 130*a* of the flat coil 130 on the non-transmission surface of the flat coil 130 between the flat coil 130 and the magnetic substance 160. Thus, the thermistor 180 mounted at one edge of the flexible substrate 181 is disposed in the air-core 130*a* of the flat coil 130. The electrode 182 of the flexible substrate 181 is connected to an electrode 143 of the wiring substrate 140.

4. Primary Coil Unit and Control Unit

Figure 4:
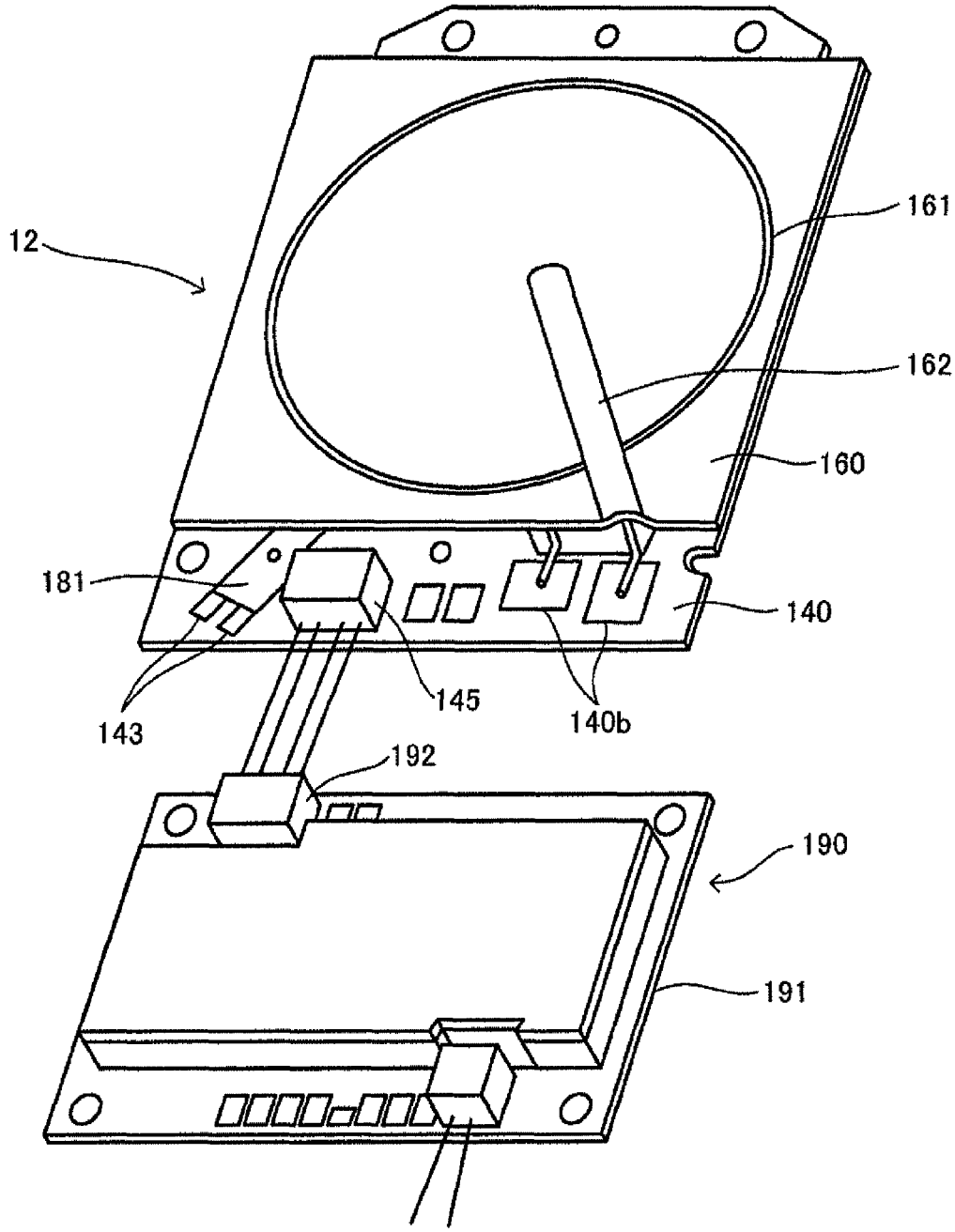
FIG. 4 is a schematic perspective view where the primary coil unit and a control unit are electrically coupled.

FIG. 4 shows a form in which the coil unit 12 and a control unit 190 are electrically coupled. The coil unit 12 and control unit 190 constitute a power transmission apparatus. The disposition of the coil inner terminal drawing line 130*b*, coil outer terminal drawing line 130*c*, flexible substrate 181, and the like of the coil unit 12 shown in FIG. 4 is different from the disposition of those of the coil unit 12 shown in FIG. 3. However, both the coil units 12 have an identical basic structure.

In the coil unit 12 shown in FIG. 4, the magnetic substance 160 disposed on the non-transmission surface of the flat coil 130 housed in the substrate 140 includes a first deformation part 161 deformed along the flat coil 130 protruding from the surface of the substrate 140 and a second deformation part 162 deformed along the coil inner terminal drawing line 130*b*. Since the flexible substrate 181 is extremely thin, the magnetic substance 160 absorbs the thickness of the flexible substrate 181 almost without deforming itself.

The control unit 190 shown in FIG. 4 is formed independently of the coil unit 12. The wiring substrate 140 of the coil unit 12 is provided with a first connector 145 connected to the external connection terminal 141 and 142 (FIG. 3). A substrate 191 of the control unit 190 is provided with a second connector 192. By electrically coupling the first connector 145 and second connector 192, the coil unit 12 and control unit 190 are electrically coupled.

The control unit 190 includes various circuits for driving the coil unit 12. For example, the control unit 190 includes a power transmission circuit for energizing the primary coil 130 to perform contactless power transmission. Such a power transmission circuit includes a power transmission control unit. The power transmission control unit receives a signal from the thermistor 180 of the coil unit 12 and, upon detection of an abnormal temperature, shuts down the primary coil 130.

5. Power Transmission Apparatus

Figure 5:
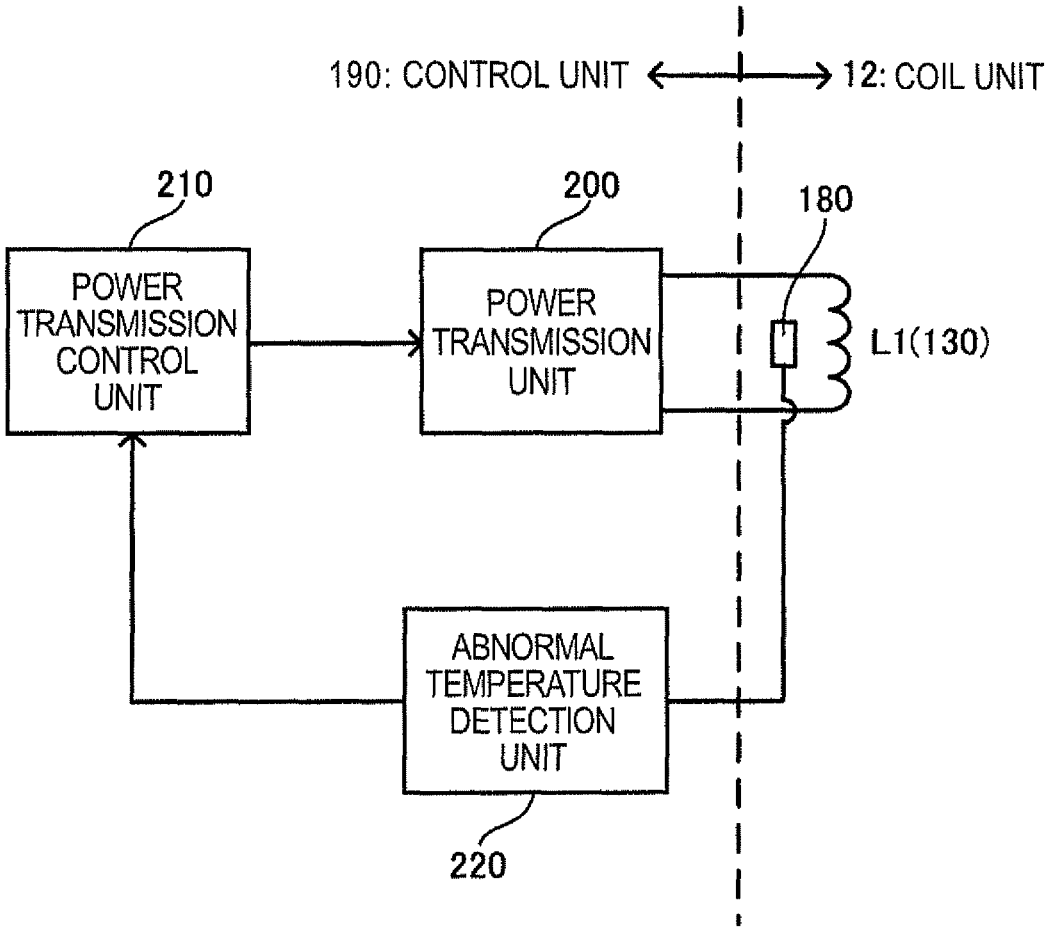
FIG. 5 is a schematic block diagram of the control unit shown in FIG. 4.

FIG. 5 is a schematic block diagram showing an example of a power transmission apparatus including the coil unit 12 shown in FIG. 3 and the control unit 190 shown in FIG. 4. As shown in FIG. 5, in this power transmission apparatus, the control unit 190 includes a power transmission unit 200, a power transmission control unit 210, and an abnormal temperature detection unit 220.

When power is transmitted, the power transmission unit 200 generates an alternating-current voltage with a predetermined frequency and provides the alternating-current voltage to the primary coil L1 (130). When data is transmitted, the power transmission unit 200 generates an alternating-current voltage with a different frequency in accordance with the data and provides the alternating-current voltage to the primary coil L1 (130). The power transmission unit 200 may include a first power transmission driver for driving one end of the primary coil L1, a second power transmission driver for driving the other end of the primary coil L1, and at least one capacitor constituting a resonant circuit together with the primary coil L1. For example, the first and second power transmission drivers included in the power transmission unit 200 are each an inverter circuit (buffer circuit) including a power MOS transistor and are controlled by the power transmission control unit 210. Control performed by the power transmission control unit 210 includes control for shutting down the primary coil L1 on the basis of a signal from the abnormal temperature detection unit 220 so as to stop power transmission.

The abnormal temperature detection unit 220 may detect an abnormal temperature itself at the time of intrusion of a foreign object on the basis of a signal from the thermistor 180 or may detect an abnormal temperature from a difference between the temperature detected by the thermistor and the ambient temperature. Also, the abnormal temperature detection unit 220 may detect an abnormality by detecting, from the thermistor temperature, the increase rate of a temperature increased rapidly at the time of intrusion of a foreign object.

6. Modifications

While this embodiment has been described in detail, it will be understood by those skilled in the art that various modifications can be made thereto without substantively departing from the novel features and advantages of the invention. Therefore, such modifications fall within the scope of the invention. For example, terms described at least once in conjunction with broader or synonymous different terms in this specification or appended drawings can be replaced with the different terms in any part of the specification or drawings.

While the above-mentioned embodiment is applied to the coil unit 12 of the primary apparatus, that is, charger 10 of the apparatuses shown in FIG. 1, the embodiment may be applied to the coil unit 22 of the secondary apparatus, that is, cell phone 20.

The above-mentioned embodiment is applicable to all electronic apparatuses that transmit power or signals. For example, the embodiment is applicable to apparatuses to be charged and including a secondary battery, such as a wristwatch, an electric toothbrush, an electric shaver, a cordless phone, a personal handy phone, a mobile personal computer, a PDA (personal digital assistants), and an electric bicycle, and chargers thereof.

Also, a coil unit to which the invention is applied is not limited to a spirally-wound, air-core coil and may be other various coils.

Figure 6:
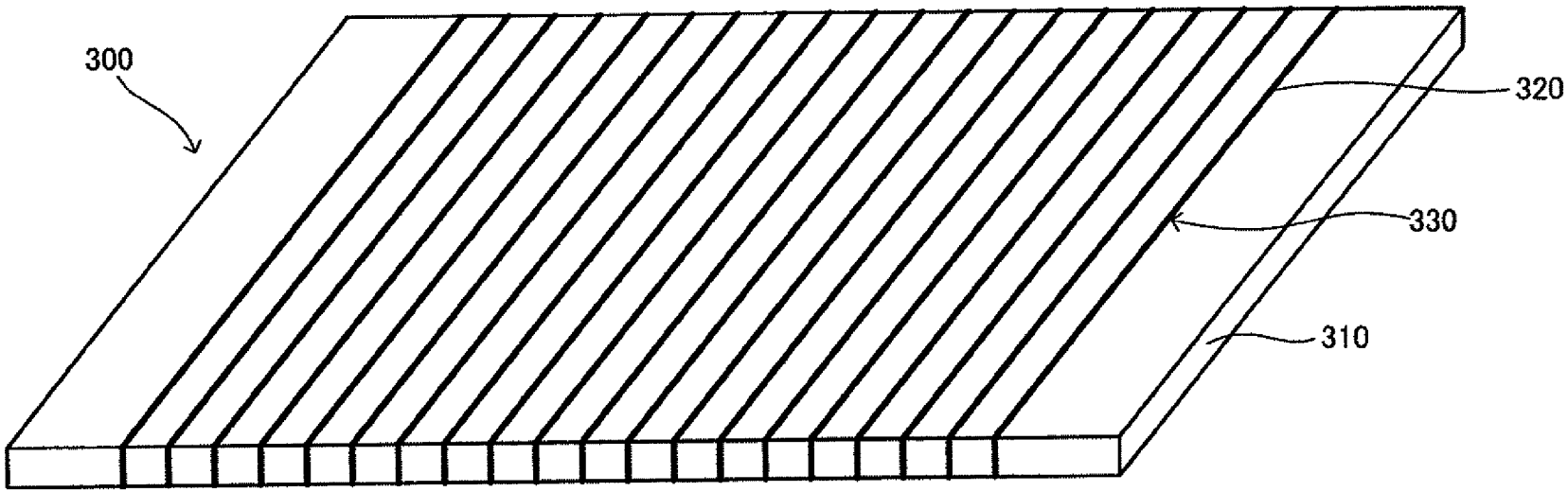
FIG. 6 is a schematic perspective view showing a coil unit of a different type.
Figure 7:
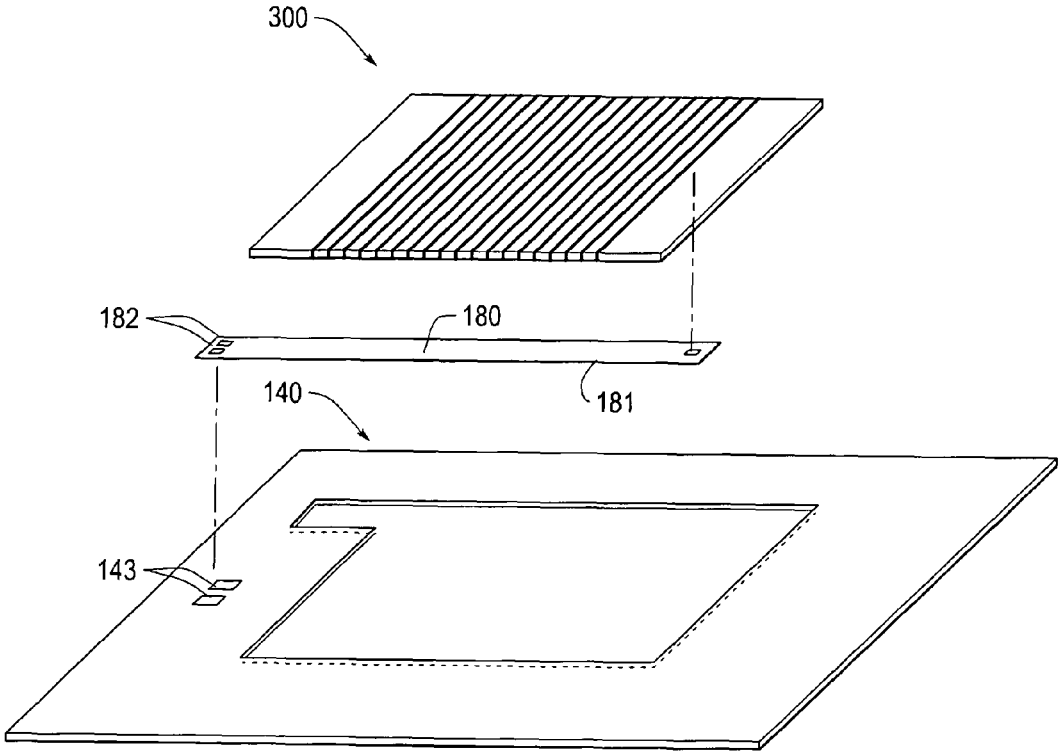
FIG. 7 is an exploded perspective view showing a coil unit of a different type.

FIGS. 6 and 7 show a coil unit 300 of a type different from that of the above-mentioned embodiment. The coil unit 300 includes, for example, a coil 330 formed by winding a coil wire 320 around a flat magnetic substance core 310. When an alternating current is passed through the coil wire 320 of the coil unit 300, a magnetic path is formed in the magnetic substance core 310 and magnetic flux lines are formed in parallel with the magnetic substance core 310. Even if the coil apparatus 300 is used as the primary coil L1, contactless power transmission is achieved by magnetic coupling with the secondary coil L2.

That is, the invention is not limited to a flat coil having a magnetic substance on a surface thereof and may be applied to a flat coil using a magnetic substance as the core thereof. Also, the combination of a coil and a magnetic substance for forming a magnetic path for the coil is not limited to the above-mentioned combination and coils having other various shapes and magnetic substances having other various shapes may be combined. Also, the invention may be applied to any type of coil if the coil can detect an abnormality on the basis of such as the rate of a temperature increase caused by heating of a foreign object that has intruded into the gap between the primary coil L1 and secondary coil L2.

What is claimed is:

1. A coil unit, comprising:

a coil including a coil wire;

a magnetic substance that receives magnetic lines of force generated by the coil;

a first substrate; and a temperature detection element disposed on the first substrate, wherein:

if one surface of the coil is referred to as a transmission surface and the other surface of the coil is referred to as a non-transmission surface, the magnetic substance is disposed on a side of the non-transmission surface of the coil, and the first substrate is disposed between the non-transmission surface of the coil and the magnetic substance, and directly contacts the magnetic substance.

2. The coil unit according to claim 1, the coil being a flat coil formed by winding the coil wire, the magnetic substance being a magnetic sheet, and the first substrate being a flexible substrate.

3. The coil unit according to claim 1, the coil being an air-core coil, and the temperature detection element being disposed in an air-core of the air-core coil.

4. The coil unit according to claim 1, further comprising a second substrate having a coil housing, a side surface of the coil housing being one of side surfaces of the second substrate, the coil being housed in the coil housing, a first electrode provided on the first substrate being connected to a second electrode provided on the second substrate.

5. The coil unit according to claim 4, each of the first substrate and the second substrate having a positioning hole through which a fixture is passed at a time of assembly so that the first substrate and the second substrate are positioned.

6. The coil unit according to claim 5, the magnetic sheet being a flexible material.

7. The coil unit according to claim 6, the magnetic sheet contacting the coil and the first substrate.

8. The coil unit according to claim 7, further comprising:

a protection sheet that protects at least the coil and covers both the transmission surface of the first substrate and the coil, the protection sheet having a position hole that corresponds to a position hole on the second substrate.

9. The coil unit according to claim 1, the coil wire being wound around the magnetic substance so that the magnetic substance is a magnetic core of the coil, and if one surface of the magnetic substance is referred to as a transmission surface of the coil and the other surface of the magnetic substance is referred to as a non-transmission surface of the coil, the first substrate is disposed on a side of the non-transmission surface of the coil.

10. An electronic apparatus comprising the coil unit according to claim 1.

11. A coil unit, comprising:

a coil including a coil wire, the coil being an air-core coil and having an air-core;

a magnetic substance that receives magnetic lines of force generated by the coil;

a first substrate; and a temperature detection element disposed on the first substrate, the temperature detection element being disposed in the air-core of the coil, wherein:

if one surface of the coil is referred to as a transmission surface and the other surface of the coil is referred to as a non-transmission surface, the magnetic substance is disposed on a side of the non-transmission surface of the coil, and the first substrate is disposed between the non-transmission surface of the coil and the magnetic substance.

* * * * *